United States Patent [19]

Goncalves

[11] Patent Number: 4,757,916

[45] Date of Patent: Jul. 19, 1988

[54] UNIT ALLOWING TWO PRODUCTS TO BE STORED SEPARATELY AND TO BE SIMULTANEOUSLY DISPENSED AFTER THEY HAVE BEEN BROUGHT INTO CONTACT

[75] Inventor: Antonin C. Goncalves, Groslay, France

[73] Assignee: L'Oreal, Paris, France

[21] Appl. No.: 92,213

[22] Filed: Sep. 2, 1987

[30] Foreign Application Priority Data

Sep. 12, 1986 [FR] France ..... 86 12756

[51] Int. Cl.[4] ..... B67B 7/24

[52] U.S. Cl. ..... 222/83; 222/153; 215/DIG. 8; 206/222; 604/88

[58] Field of Search ..... 222/80–81, 222/83, 85–86, 89, 91, 145, 153, 520–521; 206/222; 215/DIG. 8; 239/304; 604/56, 82, 87–88, 191, 416

[56] References Cited

U.S. PATENT DOCUMENTS 3,521,745 7/1970 Schwartzman ..... 215/DIG. 8
3,768,697 10/1973 Lerner ..... 222/80
3,802,604 4/1974 Morane et al. ..... 222/83
4,693,366 9/1987 Goncalves ..... 206/222

FOREIGN PATENT DOCUMENTS 0099754 2/1984 European Pat. Off. .
2339388 2/1975 Fed. Rep. of Germany ..... 206/222
2270163 12/1975 France .

*Primary Examiner*—Michael S. Huppert
*Attorney, Agent, or Firm*—Cushman, Darby & Cushman

[57] ABSTRACT

The unit delimits two compartments which are intended to contain each one product and which are separated by a separating element constituted by at least one cover perforatable as a result of the manipulation of a mixing perforator. This perforator is placed into one of the compartments, so that its cutting end comes to be near the above-mentioned separating element in the storage position, and that its other end is situated opposite a deformable obturating partition of the compartment. An element for manipulating the perforator is disposed in the extension of this latter, on the other side of the partition; it is displaceable for translation to pass from the storage position to a mixing position wherein it is acting on the perforator through the partition to cause it to cut the separating element. Can be used for storing a hair dye.

14 Claims, 3 Drawing Sheets

UNIT ALLOWING TWO PRODUCTS TO BE STORED SEPARATELY AND TO BE SIMULTANEOUSLY DISPENSED AFTER THEY HAVE BEEN BROUGHT INTO CONTACT

The present invention relates to a unit allowing two products to be stored separately and to be dispensed simultaneously after they have been brought into contact with each other.

Such storage units allow two products to be preserved independently of each other and to be mixed subsequently, for example at the time of use.

Thus one may mention by way of an example in the field of hair dyes, the storage of a colouring substance and of an oxidizing substance which must only be mixed at the time of use.

Other examples may be cited of applications of separate storage of a solid product in a pulverulent form and of a liquid product, which is, in particular a solvent of the solid question, the solution of the solid in the liquid being unstable such that it cannot be preserved for a long time while keeping its properties.

In all the cases, rather than storing the products separately and mixing them at the time of use by opening each one of the two storage units, it is preferable for the two products to be stored in one and the same unit and for a particular manipulation applied to the said unit to cause them to be brought into contact at the time of use.

The French Patent Application No. 86-00277 filed on the Jan. 10, 1986 proposes a unit for storage of this type which is made in two parts: the first comprising two compartments separated from each other by at least one cover which may be torn open; the second being constituted by a perforating cap. At the time of use, the user removes a stopper obturating one of the compartments of the first part of the storage unit and he replaces it by the perforating cap. This unit is adapted so that the preservation of the products contained in each of the compartments should be obtained as a result of a secure, reliable and controllable tightness.

However, it is considered that this structure could be improved by an automatic manipulation of a single complete unit: this is the object of the present invention.

For this purpose provision is made for the perforator intended to accomplish the mixing of the products to be disposed in one compartment, the manipulation of this perforator being ensured by an element disposed outside the said compartment, the said element and the said perforator being separated by a deformable partition, so that the manipulating element can pass from a storage position wherein it is at a distance from the said perforator into a mixing position, wherein it is at a distance from the said perforator into a mixing position, wherein it pushes the said perforator to actuate the same, being in contact therewith through the said deformable partition.

Thus in its broader aspects the present invention provides in a dispenser unit allowing two products to be stored and to be dispensed simultaneously after having been brought into contact, said unit including means defining two compartments, each for storing a respective one of said products, a separating element comprising at least one perforatable cover, and a mixing perforator adapted to be manipulated to perforate said separating element, the improvement in that the perforator is provided in one of the compartments and has a cutting end that, in the storage position of the said unit, is located near the said separating element, there is provided a deformable partition obturating the said one compartment at the end thereof opposite said separating element, said perforator having an opposite end adjacent said partition, there is provided an element for manipulating the said mixing perforator and disposed on the opposite side of the said deformable obturating partition, said manipulating element being mounted for translational displacement to pass from a storage position, where it is not in contact with the mixing perforator, to extend through said partition to a mixing position in which it acts on the said perforator to cause it to perforate the said separating element.

In accordance with a worthwhile characteristic of the invention, this deformable partition is constituted by a perforatable cover, the element for manipulating the perforator also being constituted by a perforator, which is advantageously integral with a dispensing end fitting which is fitted in a leakproof manner on the compartment accommodating the mixing perforator. In this way, one improves the seal of the compartment containing the mixing perforator, as well as the proper preservation during storage of the product contained therein.

The object of the present invention is, therefore, a new industrial product constituted by a unit allowing two products to be stored and to be dispensed simultaneously after they have been brought into contact.

Preferably a manipulating perforator is integral with an end fitting fitted on a sleeve, which delimits the compartment wherein the mixing perforator is accommodated.

Moreover, the sleeve is on the outlet end of a container delimiting the other compartment of the unit and carries the element separating the two compartments, this separating element being advantageously constituted by two thermo-welded or heat sealed perforatable covers, the first, ensuring the tightness, being fixed on an internal end skirt of the sleeve, and the second, parallel to the first, ensuring the secureness of the seal and being fixed on an external skirt of the said sleeve projecting from the internal skirt.

The sleeve may conveniently be joined to the container delimiting the compartment which does not comprise the mixing perforator by a connecting element which comprises a peripheral ring comprising a means complementary to a means carried by the external skirt of the sleeve for fastening the latter in a way which is leakproof to liquids on the said connecting element.

Moreover, the above-mentioned container terminates in a neck comprising means complementary to means carried by the connecting element for fitting this latter on the said container, the said connecting element also comprising means ensuring the tightness of its fitting on the container.

The elements of the container, of the sleeve and of the connecting element which cooperate with each other are for example, of a cylindrical shape, provision then being made for means for preventing rotation, on the one hand of the container, and on the other hand, of the sleeve in relation to the connecting element.

In accordance with another preferred characteristic of the unit according to the present invention, the dispensing end fitting is constituted by a peripheral skirt joined to a top comprising the ejection opening and carrying the manipulating perforator, the said lateral skirt cooperating with a neck formed at the corresponding end of the sleeve, the said skirt and the said neck being mounted to be displaceable in translation in relation to each other; in particular, the peripheral skirt of the closing end fitting and the neck of the sleeve can cooperate with each other by screwing.

Moreover, the peripheral skirt of the dispensing end fitting can come to surmount the neck of the sleeve, an external security and integrity ring being interposed in the storage position between the said tearable skirt and the body of the sleeve.

Moreover, provision may advantageously be made for the compartment accommodating the mixing perforator to comprise means for retaining the said mixing perforator in the storage position as well as for means for guiding the latter when it is being manipulated, and likewise for a stop against which the said mixing perforator comes to bear at the end of travel.

Thus the sleeve may comprise an internal flange carrying a tubular liner emerging from the said sleeve on the opposite side to the cutting part of the mixing perforator, the emergent end of the said liner receiving the perforatable obturating cover, the said liner constituting the means for retaining and guiding the said mixing perforator and the internal edge of said flange constituting the stop which delimits the travel of the said mixing perforator, the dispensing end fitting comprising a sealing skirt cooperating with the external side of the said liner.

The mixing perforator and the manipulating perforator may each be constituted by at least one rib, the cutting end edge whereof is chamfered.

To render the object of the present invention more readily understood, there will now be described a mode of embodiment represented in the attached drawings by way of a purely illustrative and non-restrictive example.

DETAILED DESCRIPTION OF PREFERRED EMBODIMENT

Figure 1:
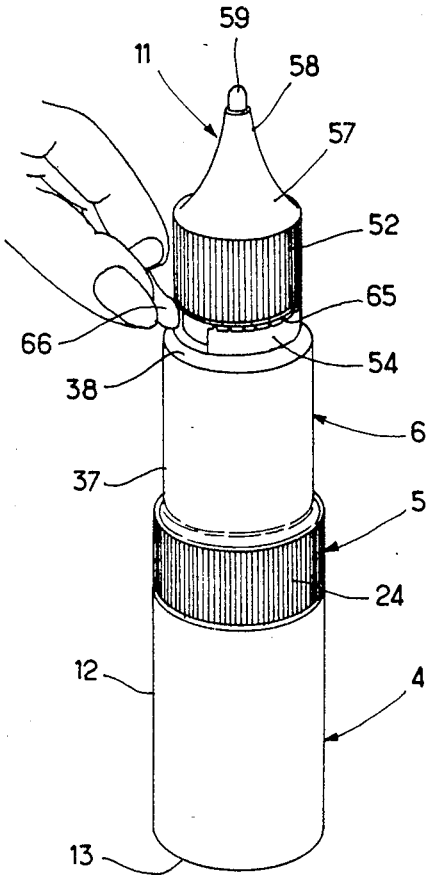
FIG. 1 is a view in perspective of a dispensing unit embodying the present invention as a user detaches a security and integrity band therefrom just before use.
Figure 2:
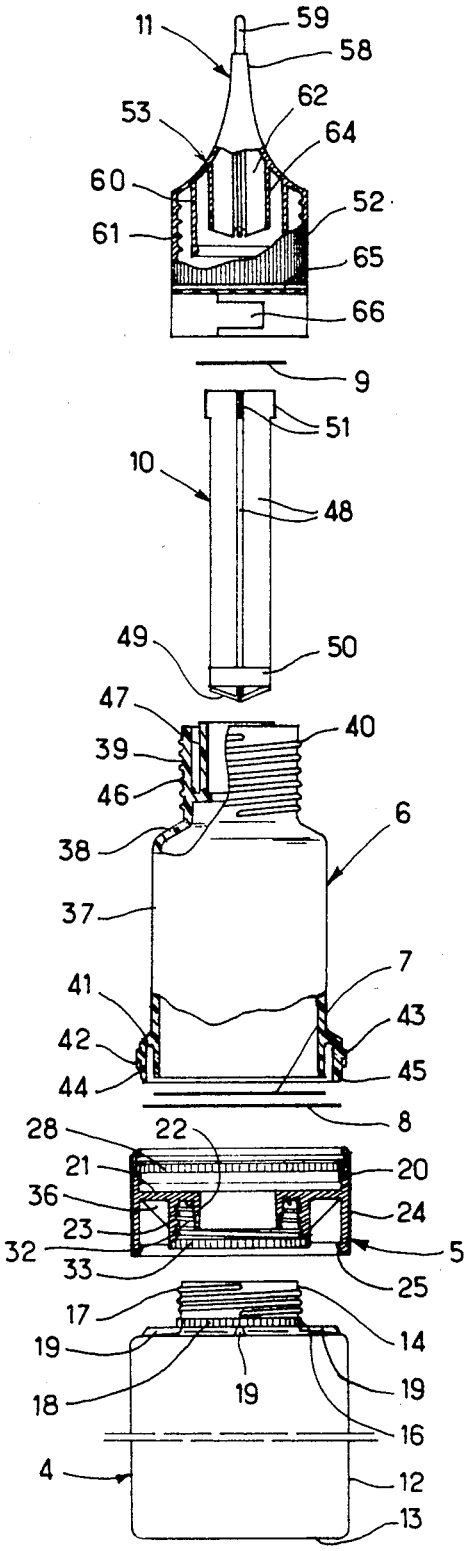
FIG. 2 is an exploded view, with some parts stripped, partly in axial cross-section, partly in elevation of the various elements constituting the unit of FIG. 1.

Referring to the drawings, it will be seen that a unit has been represented for the separate storage of an oxidizing agent and a colorant contained in two compartments designated respectively by 2 and 3, the said oxidizing agent and the said colorant having to be mixed for constituting a hair dye only at the time of use.

The compartment 2 is constituted by the interior of a bottle 4 at the upper end of which there is fitted by means of a connecting element 5 a sleeve 6. The sleeve 6 has a opening next to the bottle 4 which is obturated by two perforatable covers 7 and 8, one disposed on top of the other, the first, 7, ensuring the seal, and the second, 8, constituting a safety cover. The opening at the other end of the sleeve 6 is obturated by a perforatable cover 9. The sleeve 6 and the covers 7 and 9 define the leakproof compartment 3 containing the colorant in the storage position. Moreover, in sleeve 6 there is disposed axially a mixing perforator 10 which in its storage position extends between the covers 7 and 9, its cutting end resting on the cover 7. On the upper end of the sleeve 6 there is fitted a dispensing end fitting 11 which can be manipulated to cause the perforator 10 to be displaced in translation, the three covers 7, 8 and 9 being perforated during such manipulation, the colorant 3 thus being able to mix with the oxidizing agent 2 so as to form the hair dye to be applied. The covers 7, 8 and 9 are made of aluminium.

The bottle 4 made, for instance, of high density polyethylene has an elongate cylindrical body 12 comprising at one of its ends, a bottom 13 and at its other end, a neck 14; the neck 14 is joined to the lateral wall of the body 12 by an annular only slightly frusto-conical shoulder 15. The neck 14 has, above its transition zone with the shoulder 15, a peripheral bead 16 and between the said shoulder 15 and its free edge, a thread 17. The external lateral wall of the bead 16 comprises anti-rotation notches 18 whose function will be indicated below. Moreover, the shoulder 15 has, on its external face, four radial ribs 19 disposed at right angles, each rib 19 extending from a location adjacent the zone of transition of the neck 14 and the shoulder 15 under the bead 16 to a location near the lateral wall of the cylindrical body 12.

The connecting element 5 is made, for instance, of polypropylene. It is constituted by a cylindrical peripheral ring 20 carrying internally, substantially half way up, an annular collar 21 which is folded at right angles along its internal edge so as to constitute a sealing skirt 22 coaxial with the ring 20. Moreover, between the ring 20 and the internal skirt 22, the collar 21 carries, extending in the same axial direction as the said sealing skirt 22, a coaxial skirt 23 extending beyond the said skirt 22 but on the near side of the ring 20. The ring 20 comprises an external cylindrical wall which has externally axial striations 24 to facilitate the manipulation of the said connecting element 5.

Moreover, the ring 20 has an annular bead 25 internally along its edge situated adjacent the skirts 22 and 23. The ring 20 comprises on its internal side situated on the side to the collar 21 remote from the edge 25, successively from the collar 21 towards the free edge, a zone with an extra thickness 26, then a groove 27 whose portion next to the extra thick zone 26 comprises anti-rotation notches 28.

The skirt 22 has a free edge 30 which is chamfered, and a slight set back 29 on its external side, the set back commencing at the upper end of the chamfer.

The skirt 23 has, near its free internal edge, an annular shoulder 31 directed towards the inside which divides it into a main portion of a relatively large thickness comprising an internal thread 32 complementary to the thread 17 carried by the bottle 4 and an end portion internally comprising anti-rotation notches 33 intended to cooperate with the anti-rotation notches 18 carried by the bottle 4. The radially internal edge 34 below the shoulder 31 is chamfered.

The collar 21 comprises, between the skirts 22 and 23 a downwardly facing annular bead 35. Provision is also made on this same underside of the collar for triangular reinforcing ribs 36, joined on the one hand to the external side of the skirt 23 and on the other hand, to the annular wall of the collar 21 situated between the said skirt 23 and the external ring 20.

The sleeve 6 is advantageously made by the injection moulding of polyvinyl chloride. It comprises a cylindrical body 37 joined, at its upper end, by a shoulder 38, of an overall frusto-conical shape to a neck 39 comprising an external thread 40.

Near its free edge at its lower end the cylindrical body 37 comprises an extension 41 directed towards the outside, of a frusto-conical shape, flaring towards the said free edge, the extension 41 being folded back towards the outside to constitute a skirt 42 coaxial with the body 37 having externally, near the extension 41, a peripheral retaining ring 43 under which provision is made for anti-rotation notches 44. The assembly constituted by the retaining ring 43 and the anti-rotation notches 44 is intended to cooperate with the groove 27 of the connecting element 5, the notches 44 having to be inserted between the notches 28 of the said connecting element 5. On its external free edge, the skirt 42 has a bevel 45.

In the space delimited by the neck 39, the sleeve 6 comprises an internal annular flange 46 disposed at a short distance from the shoulder 38. This flange 46 carries, directed towards the outlet opening of the sleeve 6, a tubular liner 47 coaxial with the neck 39 and slightly projecting from the latter.

Within the sleeve 6, there is disposed the mixing perforator 10 which comprises four ribs 48 placed at right angles to each other in a generally cruciform shape when viewed in cross-section. Each rib 48 has the shape of an elongate rectangle the lower end edge of which 49 is chamfered, the ribs 48 being disposed so that the edges 49 converge into central point, coaxial with the said perforator 10, thus constituting the cutting portion of this latter. Just above this cutting portion, the ribs 48 are joined together by a cylindrical ring 50 whose axis is identical with that of the said perforator 10 and which joins the ribs 48 on the outside. Moreover, at their end opposite to the cutting portion, the ribs 48 have on their edges, axial extension ribs 51 whose function will be indicated below. The perforator 10 may be manufactured, for instance, by the moulding of a relatively rigid plastic material such a polypropylene.

Figure 3:
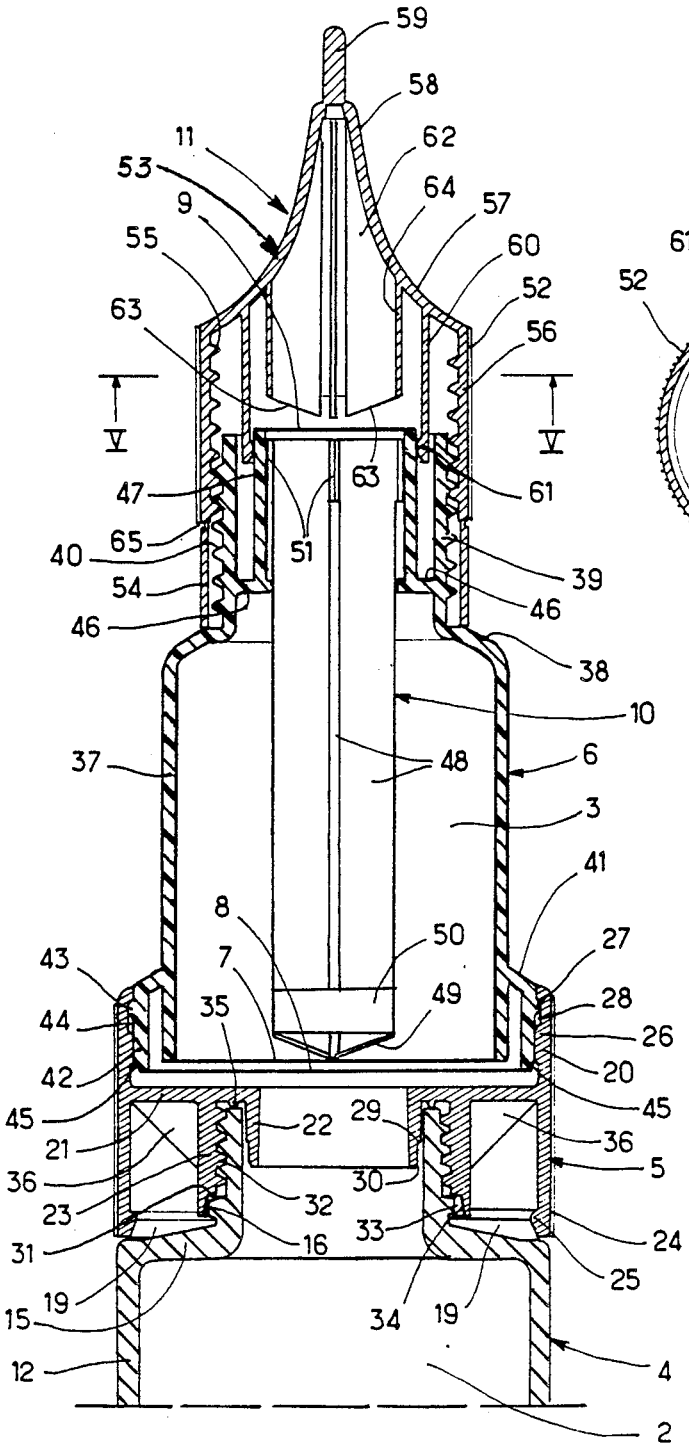
FIGS. 3 and 4 are axial cross-sectional views of the upper portion of the unit of FIG. 1 respectively in the positions of storage and of use.

The end fitting 11 is advantageously also made of a relatively rigid plastic material such as polypropylene. It is constituted by a cylindrical peripheral skirt 52 joined on the one hand to a top 53 and on the other hand, to a security and integrity band 54 which can be torn off. The cylindrical skirt 52 has, internally, a thread 55 complementary to the thread 40 carried by the sleeve 6 and, externally, axial striations 56 intended to facilitate the manipulation of the said end fitting 11. The top 53 is constituted by a portion 57 of a general frusto-conical shape which progressively tapers to constitute a nozzle 58 obturated by a stopper 59 which can be cut off. The top 53 comprises an internal skirt 60 coaxial with the skirt 52 which is of a shorter length than the latter and whose internal side carries along its free edge, a peripheral bead 61. In the storage position, which is that of FIG. 3, the bead 61 is positioned at the upper portion of the liner 47, since the skirt 60 is inserted with its end just projecting into the annular space which is situated between the liner 47 and the neck 39. In this position, the cutting portion formed by the base of the rib 62 is not in contact with the upper cover 9.

Figure 5:
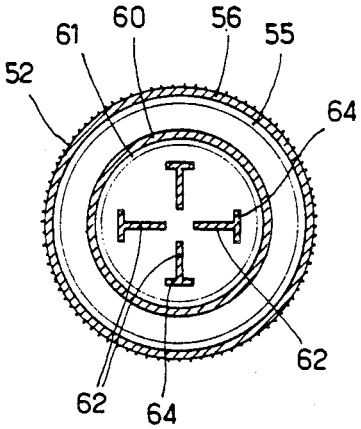
FIG. 5 is a cross-sectional view taken along V—V of FIG. 3.

In the space delimited by the skirt 60, the top 53 comprises a manipulating perforator 62 constituted by four radial ribs disposed at 90° to each other whose lower edges 63 are chamfered so that the four chamfered edges constitute a cutting element forming a central perforating tip. Moreover, the ribs of the manipulating perforator 62 are stiffened by end strips 64 disposed perpendicular to the ribs (FIG. 5).

The security and integrity band 54 is situated as an extension of the skirt 52 to which it is joined by fasteners 65 disposed at intervals and having a very small thickness so as not to offer any substantial resistance when this band 54 is to be torn off, which action is started by seizing the gripping tab 66 (shown in FIG. 1).

The storage arrangement by means of this unit described above is effected as follows:

the cover 7 is sealed against the free edge of the body 37 of the sleeve 6, and then the cover 8 is sealed against the free edge of the skirt 43;

the connecting element 5 is fixed axially by causing it to slide in relation to the sleeve 6 until the groove 27 of the element 5 receives the retaining ring 43 of the skirt 42 of the sleeve 6, the anti-rotation notches 28 and 44 cooperating with each other to prevent any relative swivelling motion between the sleeve 6 and the connecting element 5;

the appropriate quantity of the colorant is introduced into the compartment 3 delimited by the sleeve 6 and the cover 7;

the perforator 10 is positioned by introducing it axially into the sleeve 6 through the opening defined by the liner 47, the perforator 10 being held in position by the ribs 51 bearing against the internal upper side of the liner 47; in this position, the lower cutting portion of the perforator 10 is adjacent to or rests on the cover 7;

the third aluminium cover 9 is sealed on the edge of the liner 47;

the end fitting 11 is then positioned by screwing it on to the threaded neck 39 of the sleeve 6;

having introduced the necessary quantity of the oxidizing agent into the bottle 4; the sub-unit whose assembly has just been described is disposed on the said bottle 4 and is fixed thereto by screwing the element 5 of the said sub-unit onto the neck 14 of the bottle 4 until the bead 16 of the neck 14 of the bottle 4 is surrounded by the lower portion with a smaller thickness of the skirt 23 of the element 5, the anti-rotation notches 33 cooperating with the anti-rotation notches 18 of the neck 14; in this way one prevents any relative swivelling motion between the bottle 4 and the element 5; the cooperation of the radial ribs 19 and of the bead 25 having the same effect.

It will be found that in this way the seal of the compartment 3 containing the colorant is perfectly accomplished at the bottom by the lower two covers 7 and 8 and at the top by the upper cover 9 and finally, by the bearing of the bead 61 of the skirt 60 of the end fitting 11 against the liner 47 of the sleeve 6.

The seal of the compartment 2 containing the oxidizing agent is also satisfactory. It will, however, be observed that between the cover 8 and the collar 21 of the connecting element 5, one leaves a very small clearance permitting a possible evacuation of gas deriving from the decomposition of the oxidizing agent contained in the bottle 4. In effect, if this oxidizing agent is hydrogen peroxide, the decomposition of the latter entails a production of oxygen which can create excess pressure in the bottle 4 detrimental to its preservation. Because of the clearance described above, the oxygen can escape from the bottle 4 by passing between the skirt 42 of the sleeve 6 and the peripheral ring 20 of the connecting element 5; a microleak is thus obtained.

Figure 4:
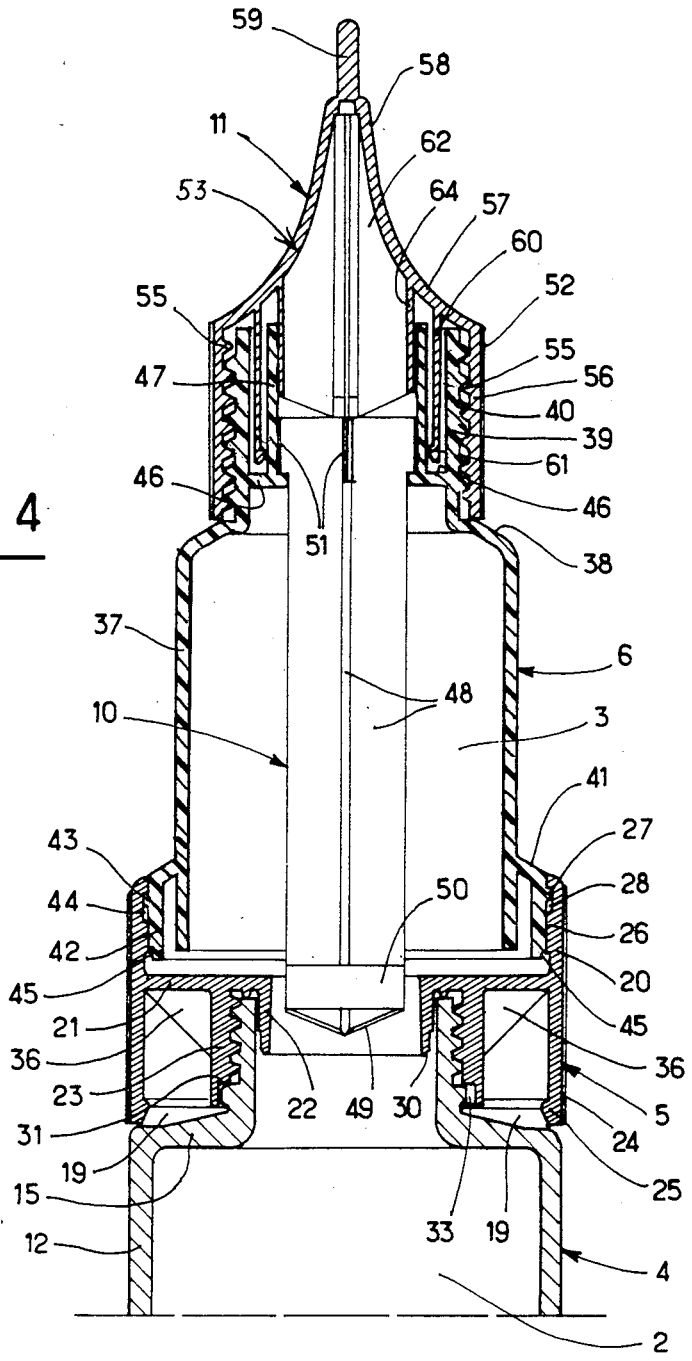

When the user wishes to dispense the mixture of the oxidizing agent 2 and of the colorant 3, it suffices for him to tear off the security and integrity band 54 by seizing the tab 66. Once the band has been torn off, the user screws down the end fitting 11 on to the sleeve 6 which brings the unit into the position of FIG. 4. During this screwing motion, the four perforator ribs 62 pierce the top cover 9, these ribs then producing the downward translation of the perforator 10, which effects the perforation first of the cover 7, then of the cover 8. At the end of its travel, the perforator 10 is retained by the internal edge of the flange 46 which serves as stop for the lower edges of the ribs 51 of the perforator 10. In the movement of opening the covers 7 and 8, the ring 50 makes it possible to ensure a maximum opening so that subsequently, the mixing of the oxidizing agent and of the colorant is effected in the best possible conditions.

When the user wishes to dispense this mixture, it suffices for him to shake the unit, then to cut off the stopper 59 which allows the opening of the nozzle 58 to be freed.

It shall be duly understood that the mode of embodiment described above is in no way restrictive and may give rise to any desirable modifications without thereby departing from the scope of the invention as defined by the appended claims.

I claim:

1. In a dispenser unit allowing two products to be stored and to be dispensed simultaneously after having been brought into contact, said unit including means defining two compartments, each for storing a respective one of said products, a separating element interposed between said two comparatments comprising at least one perforatable cover, and a mixing perforator adapted to be manipulated to perforate said separating element, the improvement in that the perforator is provided in one of the compartments and has a cutting end that, in the storage position of the said unit, is located near the said separating element, there is provided a deformable partition obturating the said one compartment at the end thereof opposite said separating element, said perforator having an opposite end adjacent said partition, there is provided an element for manipulating the said mixing perforator and disposed on the opposite side of the said deformable obturating partition, said manipulating element being mounted for translational displacement to pass from a storage position, where it is not in contact with the mixing perforator, to extend through said partition to a mixing position in which it acts on the said perforator to cause it to perforate the said separating element.

2. A unit according to claim 1, wherein the obturating partition of the said one compartment is constituted by a perforatable cover and the manipulating element is constituted by a manipulating perforator, the said one compartment is defined within a sleeve and said unit includes a dispensing end fitting fitted on said sleeve.

3. A unit according to claim 2, wherein the other compartment of the unit is defined by a container having an open outlet end, said sleeve being fitted on the said outlet end and carrying said separating element.

4. A unit according to claim 3, wherein the sleeve is provided with an internal end skirt and an external skirt projecting from the internal skirt, and the separating element is constituted by first and second perforatable covers, the first cover ensuring the seal and being fixed on said internal end skirt and the second cover parallel to the first ensuring a secure obturation being fixed on said external skirt.

5. A unit according to claim 4, wherein the other compartment is defined by a container and there is provided a connecting element connecting the sleeve to the container.

6. A unit according to claim 5, wherein the connecting element comprises a peripheral ring and complementary means are provided on said ring and on the external skirt of the sleeve for the attachment, leakproof to liquids, of the sleeve on the said connecting element.

7. A unit according to claim 5, wherein the container terminates in a neck comprising means complementary to means carried by the connecting element for fitting this latter on the said container, the said connecting element also comprising means which ensure the tightness of its mounting on the container.

8. A unit according to claim 6, wherein the container, the sleeve and the connecting element include cooperating members that are cylindrical in shape, such members including mutually cooperating means to prevent rotation of at least one of the container and the sleeve in relation to the connecting element.

9. A unit according to claim 2, wherein the end fitting comprises a top comprising the ejection orifice and carrying the manipulating perforator, a cylindrical skirt joined to the top, the said skirt cooperating with a neck formed at the corresponding end of the sleeve, the said skirt and the said neck being mounted for translational displacement in relation to each other.

10. A unit according to claim 9, wherein the cylindrical skirt of the dispensing end fitting and the neck of the sleeve cooperate with each other by screwing.

11. A unit according to claim 9, wherein the cylindrical skirt of the end fitting comes to surmount the neck of the sleeve, there being provided an external security and integrity ring interposed in the storage position between the said skirt and the body of the sleeve.

12. A unit according to claim 1, wherein the one compartment comprises means for retaining the said mixing perforator in the storage position, as well as means for guiding the latter when it is manipulated.

13. A unit according to claim 2, wherein the one compartment accommodating the mixing perforator comprises a stop against which the said mixing perforator comes to bear at the end of travel.

14. A unit according to claim 13, wherein the sleeve at the end thereof adjacent said deformable partition comprises an internal flange carrying a tubular liner projecting from the said sleeve and carrying said partition, the said liner constituting means for retaining and guiding the said mixing perforator and the internal edge of the said flange constituting the stop which limits the travel of the said mixing perforator, the end fitting comprising a sealing skirt cooperating with the external side of the said liner.

* * * * *